US008132486B1

(12) United States Patent
Calvert

(10) Patent No.: US 8,132,486 B1
(45) Date of Patent: Mar. 13, 2012

(54) POWER SCREW GUN WITH HAMMER HEAD

(76) Inventor: Norman D. Calvert, Marcellus, MI (US)

( * ) Notice: Subject to any disclaimer, the term of this patent is extended or adjusted under 35 U.S.C. 154(b) by 370 days.

(21) Appl. No.: 12/488,308

(22) Filed: Jun. 19, 2009

Related U.S. Application Data

(63) Continuation-in-part of application No. 12/413,962, filed on Mar. 30, 2009, now abandoned, which is a continuation-in-part of application No. 11/761,022, filed on Jun. 11, 2007, now abandoned.

(51) Int. Cl.
*B25B 21/00* (2006.01)

(52) U.S. Cl. ..... 81/54; 81/180.1; 81/25

(58) Field of Classification Search ..... 81/52, 54, 81/180.1, 185.2, 25, 26; 7/143, 165
See application file for complete search history.

(56) References Cited

U.S. PATENT DOCUMENTS

| | | | | | |
|---|---|---|---|---|---|
| 1,303,090 | A * | 5/1919 | McCray | 30/308.3 |
| 2,903,932 | A * | 9/1959 | McGonagill | 173/121 |
| RE24,831 | E * | 5/1960 | Livermont | 81/177.85 |
| 3,560,008 | A * | 2/1971 | Taylor | 279/19 |
| 4,450,919 | A * | 5/1984 | Cousineau | 173/29 |
| D335,620 | S * | 5/1993 | Farian et al. | D8/68 |
| 5,746,096 | A * | 5/1998 | Lukes | 81/54 |
| D454,475 | S * | 3/2002 | Taga | D8/61 |
| 6,776,069 | B2 * | 8/2004 | Soreo et al. | 81/54 |
| 2006/0213014 | A1 * | 9/2006 | Manske | 7/165 |
| 2007/0227310 | A1 * | 10/2007 | Roehm et al. | 81/54 |

* cited by examiner

*Primary Examiner* — Debra S Meislin
(74) *Attorney, Agent, or Firm* — Mathew R. P. Perrone, Jr.; Brie A. Crawford

(57) ABSTRACT

A pneumatic power screw gun with a reinforced hammer head, has a reinforced base end above the handle with a cradle mounted thereon, the cradle being adapted to receive and secure a hammer head in place as desired.

20 Claims, 12 Drawing Sheets

POWER SCREW GUN WITH HAMMER HEAD

CROSS REFERENCE TO RELATED APPLICATION

This application is a continuation in part application of U.S. application Ser. No. 12/413,962, now abandoned, filed on Mar. 30, 2009, which is a continuation in part application of U.S. application Ser. No. 11/761,022, now abandoned, filed Jun. 11, 2007, both being by the same inventive entity.

This invention relates to a power screw gun with a hammer head and more particularly to a pneumatic power screw gun with a reinforced hammer head.

BACKGROUND OF THE INVENTION

In a process of using a powered screw gun, it becomes necessary to strike the screw at times and finish setting the screw in the desired surface. To that end, a worker will commonly use the base end of the powered screw gun to set a screw. A powered screw gun is not designed for such use as a hammer.

When a powered screw gun is used as a hammer, the screw gun must suffer some damage. The damage may cause either damage on the external casing or internal powered source of the screw gun. Clearly, such damage can adversely affect the screw gun. Thus, there is an advantage in minimizing damage to the powered screw gun.

SUMMARY OF THE INVENTION

Among the many objectives of the present invention is the provision of a pneumatic power screw gun with a reinforced hammer head.

Another objective of the present invention is the provision of a pneumatic power screw gun with a replaceable hammer head.

Yet another objective of the present invention is the provision of a pneumatic power screw gun with a reinforced mounting for a hammer head.

These and other objectives of the invention (which other objectives become clear by consideration of the specification, claims and drawings as a whole) are met by providing a pneumatic power screw gun with a reinforced hammer head, having a reinforced base end with a stamped cradle mounted thereon, the stamped cradle being adapted to receive a hammer head.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Figure 1:
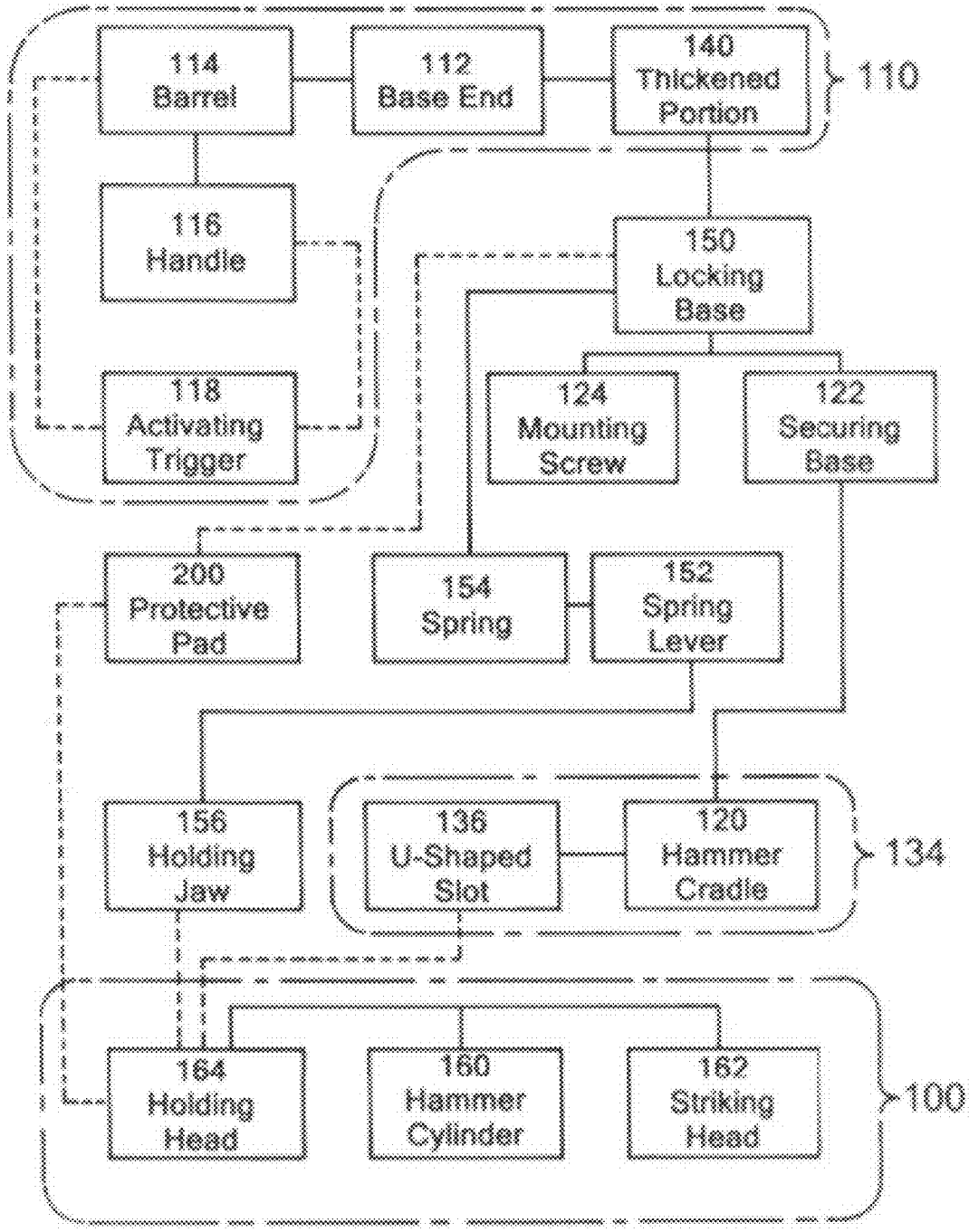
FIG. 1 depicts a block diagram of the reinforced hammer head 100 of this invention mounted on a screw gun 110.
Figure 2:
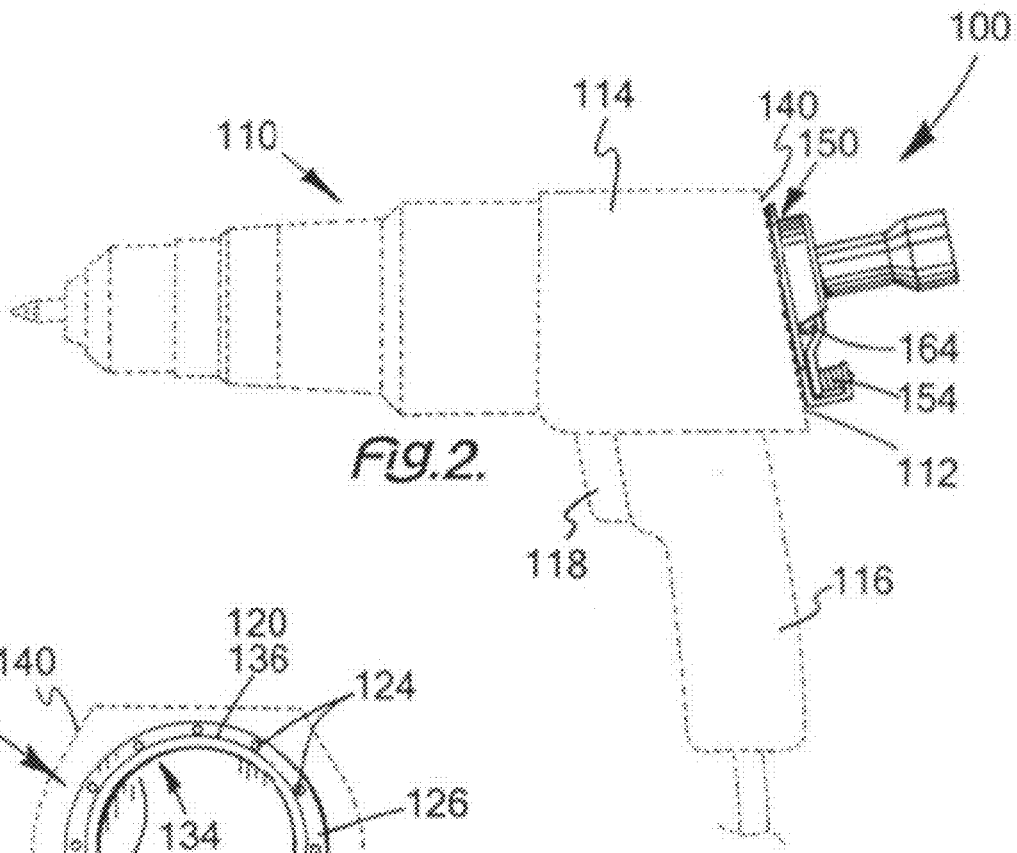
FIG. 2 depicts a side view of the reinforced hammer head 100 of this invention mounted on a screw gun 110, which is shown in phantom.
Figure 3:
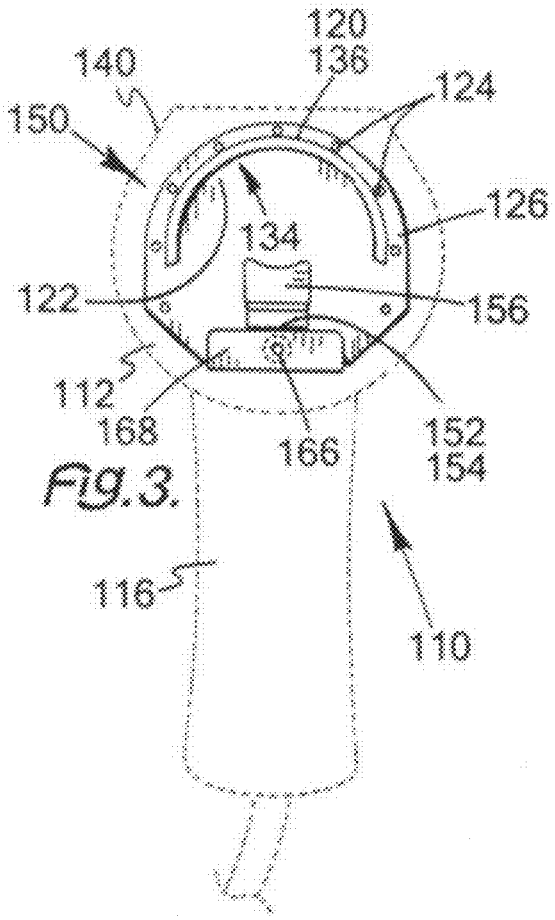
FIG. 3 depicts a rear plan view of the locking base 150 mounted on screw gun 110, shown in phantom, for hammer head 100 of this invention.
Figure 4:
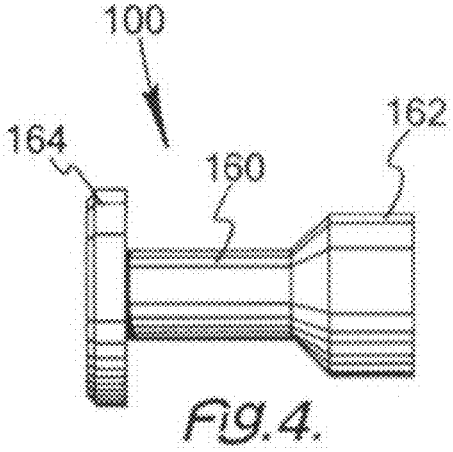
FIG. 4 depicts a side view of the hammer head 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar to directional term are not to be construed to limit the scope of the invention in any manner. The words attach, connect, couple, and similar terms with their inflectional morphemes do not necessarily denote direct or intermediate connections, but may also include connections through mediate elements or devices.

The hammer head of this invention is mounted on a rear portion of the power screw gun. The screw gun has a barrel with a screw ejecting end and operably disposed base end. Adjacent to the base end a handle extends there below. At the juncture of the handle and the barrel is the trigger for the screw gun.

The base end of the screw gun has a thickened portion. The thickened portion is a thicker layer or additional layers of material, preferably steel or another hard metal, on the base end of the screw gun. In the preferred embodiment, the top portion has an added thickness of 1 to 2.54 centimeters (½ to 1 inch) while the rear portion has an added thickness of 1.90 to 3.81 centimeters (¾ to 1.5 inches). The thicker portion or reinforced backing protects the internal components of the screw gun while it is being used as a hammer. The thickened portion is added to the screw gun by casting or any other suitable method. As an added safety feature, the thickened portion of the screw gun is angled upward and away from the screw gun handle where a user grips. In the preferred embodiment, the angle is approximately 35 to 65 degrees upward. This protects the user from accidentally striking their body instead of the work surface.

To the base end or thickened portion of the screw gun is secured a U-shaped rim and spring lever. These components cooperate to form the hammer cradle which is the space in which the holding head or base rests and is supported by any appropriate structures. In the preferred embodiments, the cradle is supported by the U-shaped rim and the spring lever. Into the cradle is fitted a hammer head. The hammer head has a holding head or base which fits into the cradle in a slidable fashion. The holding head or base is in a male to female relationship with the cradle. The spring lever releasably secures the holding head or base in the cradle. Oppositely disposed from the holding head or base is the striking head.

Because the thickened portion or reinforced backing reinforces the base end of the screw gun, the striking head may be used with little or no damage to the screw gun. With the holding head or base securing the hammer head in place, great efficiency is achieved by having a hammer ready for use.

The striking head is preferably made of metal. The metal can be steel, aluminum, brass, copper, babbet metal, or any other suitable metal. In other embodiments, the hammer head can be made of rolled rawhide, plastic, ballistic plastic, wood, resin, rolled wax, rubber, leather or any other suitable material. Each hammer head has a metal base which must be constructed of a hard steel or an aluminum alloy, or any other suitable metal.

However, the metal hammer head is discussed in the preferred embodiments. A series of hammer heads of different materials can be provided and be completely interchangeable. This provides the user with great versatility such that the same tool can function as a metal hammer, a rubber mallet, and any other variety of combinations.

The screw gun to which the hammer head attaches can be manufactured with the necessary structure to accept the required components. Or, the screw gun can be retro fitted to provide the structure necessary to accept the hammer head. An existing screw gun would need to be modified to have the bores, apertures, and angles to cooperate with the hammer head. The base end can be casted, drilled, or tapped, or any other suitable method, to create the attachment apertures and the spring cavity. Moreover, the base end of the screw gun can be appropriately angled by casting or any other method.

Referring now to FIG. 1, hammer head 100 is secured on screw gun 110 at the base end 112. Screw gun 110 has a barrel 114, a base end 112, and a thickened portion 140 or reinforced backing. Below barrel 114 and extending from the base end 112 is handle 116 of the screw gun 110. The actuating trigger 118 of screw gun 110 is positioned between handle 116 and barrel 114. When the actuating trigger 118 is activated, the screw gun 110 acts as a standard power or pneumatic screw gun 110.

Figure 13:
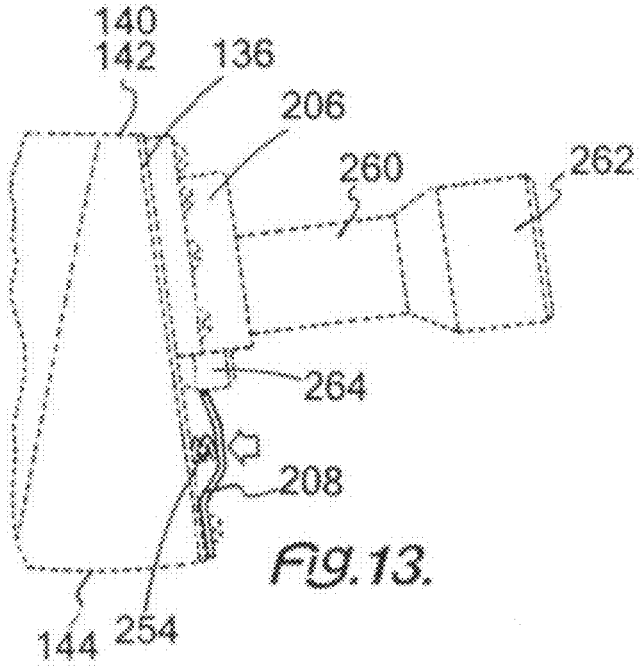
FIG. 13 depicts a side view of preferred hammer head 198 of this invention.

The screw gun 110 has a thickened portion 140 or reinforced backing in its housing (as depicted in FIG. 13). The thickened portion 140 has extra metal, or any other suitable material, to provide a reinforcement to prevent or reduce damage to the screw gun 110 while it is being used as a hammer. The top portion 142 and the rear portion 144 have a thicker metal layer to increase the durability and longevity of screw gun 110. In the preferred embodiment, the top portion has an added thickness of 1 to 2.54 centimeters (½ to 1 inch) while the rear portion has an added thickness of 1.90 to 3.81 centimeters (¾ to 1.5 inches). The thickened portion 140 of the screw gun 110 is angled upward, extending away from handle 116 as an safety precaution for the user.

To base end 112 is secured locking base 150, by welding, bolting, gluing screwing, riveting, or any other appropriate means. Hammer cradle 120 receives hammer head 100 in a slidable fashion. Hammer cradle 120 is the portion of the locking base under U-shaped rim 136 and beneath spring lever 152 where holding head or base 164 rests and is supported by U-shaped rim 136 and spring lever 152. Base end 112 can be made with a thickened portion 140, can rely on the locking base 150 or can have combinations thereof in order to provide the desired strength for mounting the hammer head on the screw gun.

Adding FIG. 2, FIG. 3, FIG. 4, FIG. 5, and FIG. 6 to the consideration, the structure of hammer head 100 becomes more clear. Screw gun 110 has base end 112 is reinforced with a thickened portion 140, onto which, the locking base 150 may be mounted. Locking base 150 includes a securing base 122 of locking base 150, which is directly secured to base end 112.

Hammer head 100 has hammer cylinder 160, striking head 162, and holding head or base 164. Holding head or base 164 secures the hammer head to the locking base 150 and screw gun 110.

More particularly, securing base 122 has a mounting rim 126 to aid in securing it to base end 112. Mounting rim 126 is positioned around the outer edge of locking base 150 and includes a series of rim apertures 128. A mounting screw 124 cooperates with each rim aperture 128 to secure the locking base 150 to base end 112 of the screw gun 110.

Locking base 150 also has a U-shaped rim 136. The U-shaped rim cooperates with locking base 150 to attach and secure holding head or base 164 to the screw gun 110.

Moreover, locking base 150 also has spring lever 152 which is mounted over cradle 120 on the base of locking base 150. Spring lever 152 cooperates with the U-shaped rim 136 to secure reinforced hammer head 100 in hammer cradle 120 by holding head or base 164.

A U-shaped retaining lip 168 extends from the base of locking base 150. Spring lever 152 inserts between the locking base 150 and retaining lip 168. Spring lever 152 has a spring lever aperture 170. Holding jaw 156 extends from the top of spring lever 152.

The spring lever is attached through its cooperation with base end 112, locking base 150 and U-shaped retaining lip 168. Locking base 150 has locking base aperture 172, base end 112 has base end apertures 202, and retaining lip 168 has retaining lip aperture 166. Spring screw 158 cooperates with retaining lip aperture 166, spring 154, spring lever aperture 170, locking base aperture 172, and base end apertures 202 to securely attach the spring 154 and spring lever 152 to locking base 150. Also, the spring screw 158 helps to further secure the locking base 150 to base end 112.

In this embodiment, screws are used to secure the spring lever 152 and the locking base 150 in proper position. However, these components may be securely attached by welding, with rivets, or with any other suitable fastening device or method.

U-shaped rim 136 is raised above base end 112. Holding head or base 164 slides under holding jaw 156 and abuts against U-shaped rim 136 to secure it in hammer cradle 120. Holding jaw 156 retains holding head or base 164 against locking base 150 and in hammer cradle 120. U-shaped rim 136 forces the holding head or base 164 downward and under holding jaw 156, thus securing hammer head 100 to screw gun 110.

Hammer receiver 134 is the combination of the hammer cradle 120 and the U-shaped rim 136. At least partially closing the hammer cradle 120 is a spring lever 152 with spring 154 supporting the spring lever 152. Spring lever 152 extends into holding jaw 156 to contact hammer head 100.

Hammer head 100 has a holding head or base 164 adapted to slide into cradle 120. As holding head or base 164 (FIG. 4) slides into cradle 120, spring lever 152 is depressed and moved by the locking base 150 of hammer head 100. As holding head or base 164 pushes against spring lever 152, it rises from its depression due to spring 154 secured thereunder and engages holding head or base 164 with holding jaw 156. As the holding head or base 164 slides over the spring lever 152 and into the U-shaped rim 136, it rests in U-shaped rim 136 and the spring lever 152 contacts its edge to secure it in place. In this manner, spring lever 152 and U-shaped rim 136 cooperate to hold hammer head 100 in place.

To remove or replace hammer head 100, spring lever 152 is depressed. Then, hammer head 100 slides thereover and is removed from hammer receiver 134. Mounting of the hammer head 100 in the hammer receiver 134 requires a reverse procedure. The holding head or base 164 of hammer head 100 extends along to hammer cylinder 160 and then into striking head 162 of hammer head 100. With the support of locking base 150, striking head 162 of hammer head 100 may be effectively used, with greatly reduced or eliminated damage to screw gun 110.

Figure 5:
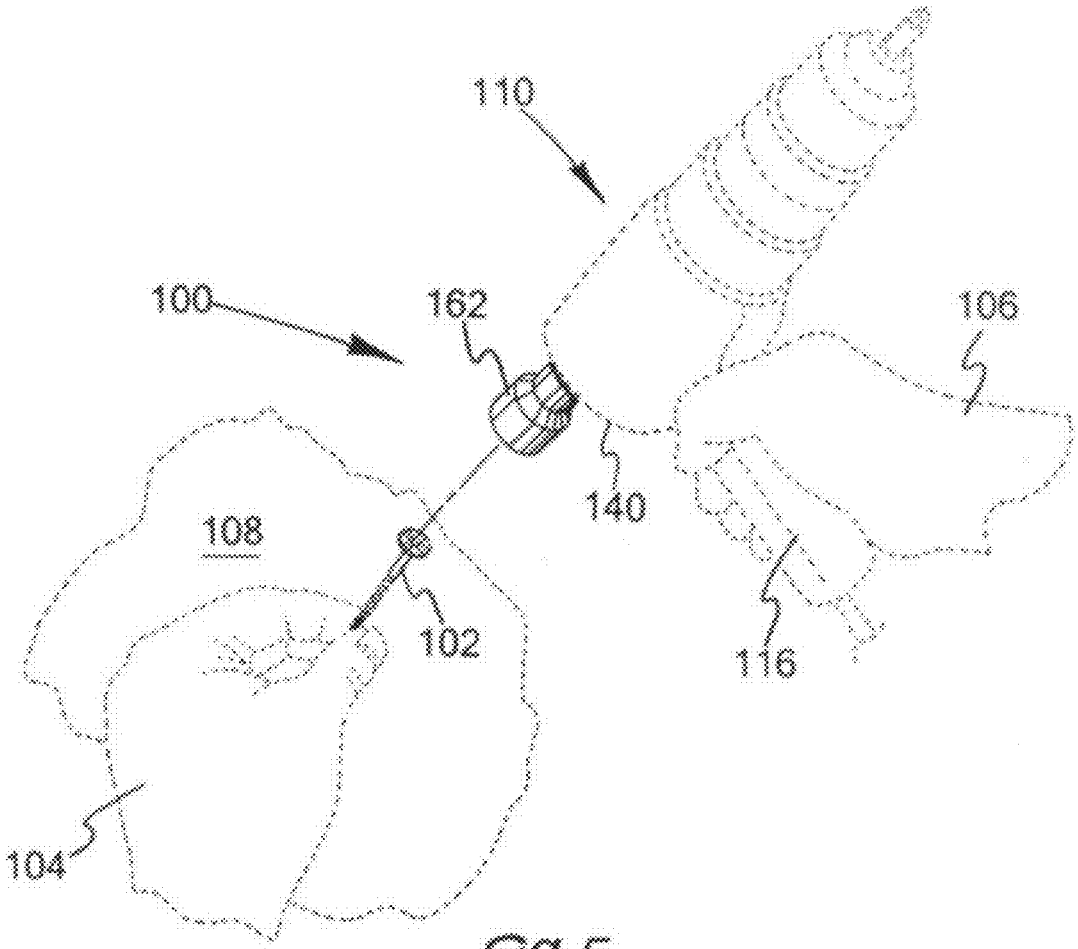
FIG. 5 depicts a perspective view of the hammer head 100 of this invention with screw gun 110 shown in phantom.
Figure 6:
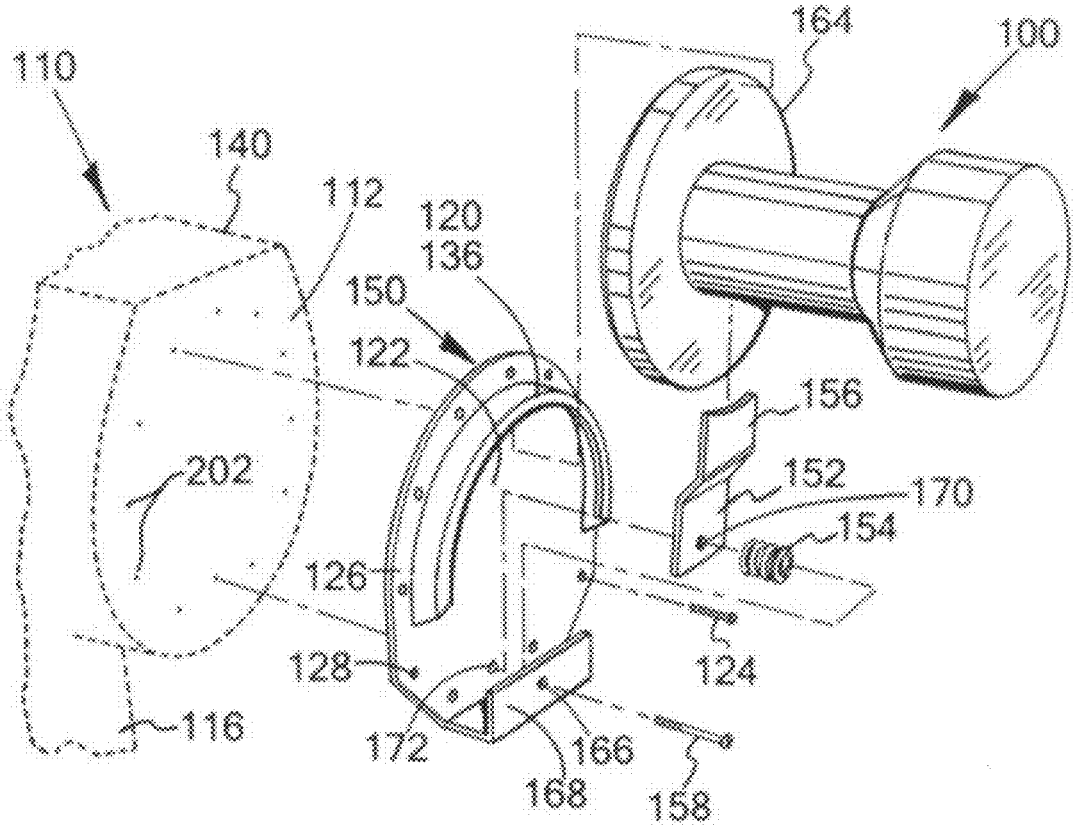
FIG. 6 depicts an exploded perspective view of the hammer head 100 of this invention mounted on screw gun 110, which is shown in phantom.

Adding more consideration to FIG. 5, screw 102 is held by steadying hand 106 adjacent to a screw receiving surface 108. Screw gun hand 106 adjusts screw gun 110 so that striking head 162 of hammer head 100 can contact screw 102, either before or after using the screw gun 110 to drive screw 102. Thus, setting of screw 102 becomes much more efficient.

Figure 7:
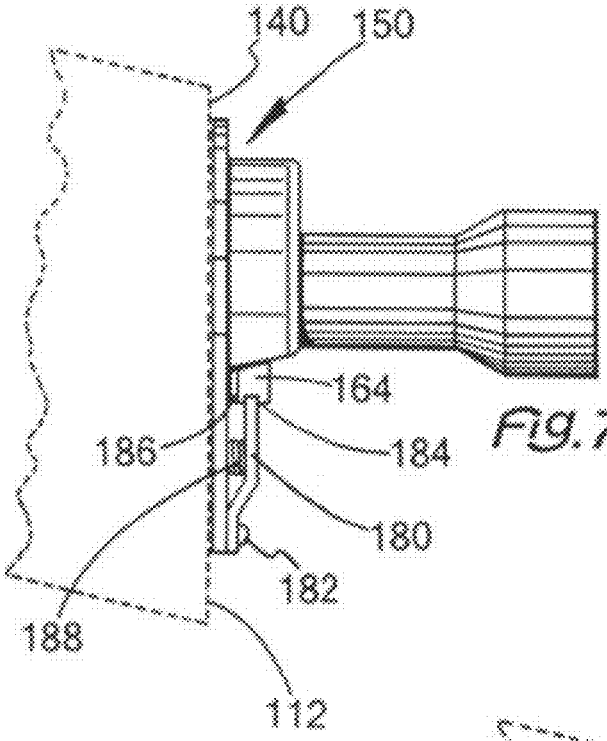
FIG. 7 depicts a side view of the hammer head 100 of this invention mounted on screw gun 110, which is shown in phantom, with spring 188.
Figure 8:
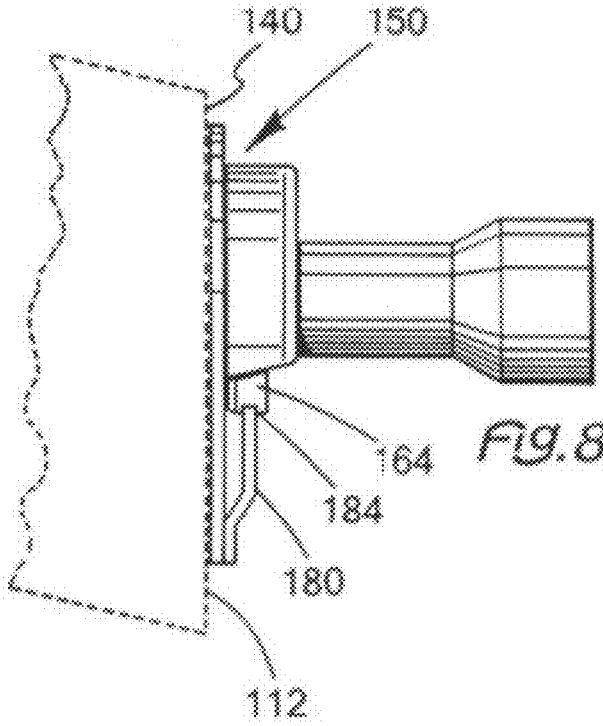
FIG. 8 depicts a side view of the hammer head 100 of this invention mounted on screw gun 110, which is shown in phantom, without spring 188.

Turning now to FIG. 7 and FIG. 8, holding head or base 164 of reinforced hammer head 100 is positioned in locking base 150 of hammer cradle 120. U-shaped rim 136 has a greater depth in this embodiment. Free spring arm 180 is a flexibly supporting member secured to locking base 150 by arm screw 182 (as depicted in FIG. 7). Contact tip 184 is oppositely disposed from arm screw 182 and contacts holding head or base 164 at a side point thereof. Tapered portion 186 of holding head or base 164 facilitates insertion and removal of hammerhead 100 from screw gun 110.

When comparing FIG. 7 and FIG. 8, the spring 188 is in FIG. 7, while FIG. 8 eliminates spring 188 and relies on free spring arm 180 alone. Either structure is operable. Also, the holding head or base 164 is attached and removed in the same fashion as discussed previously.

Figure 9:
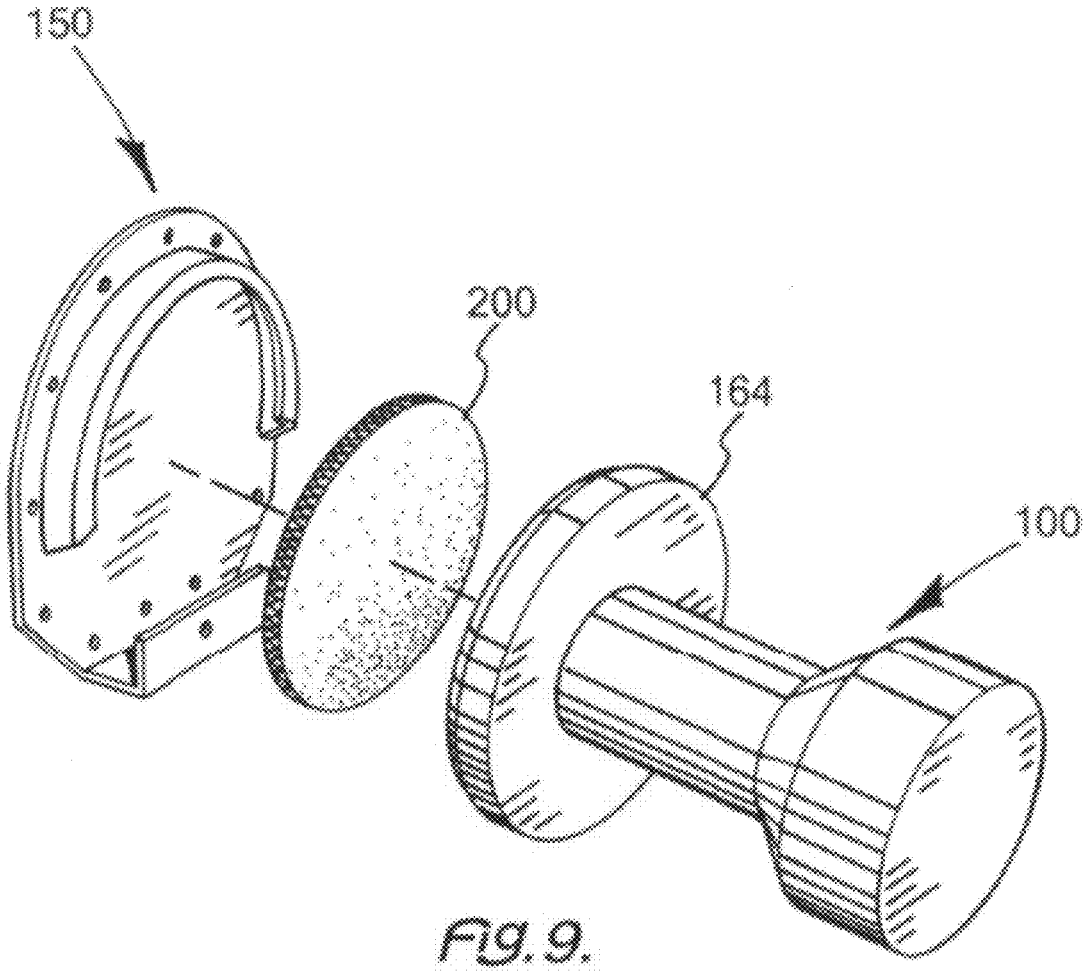
FIG. 9 depicts an exploded perspective view of hammer head 100 of this invention with optional protective pad 200.
Figure 10:
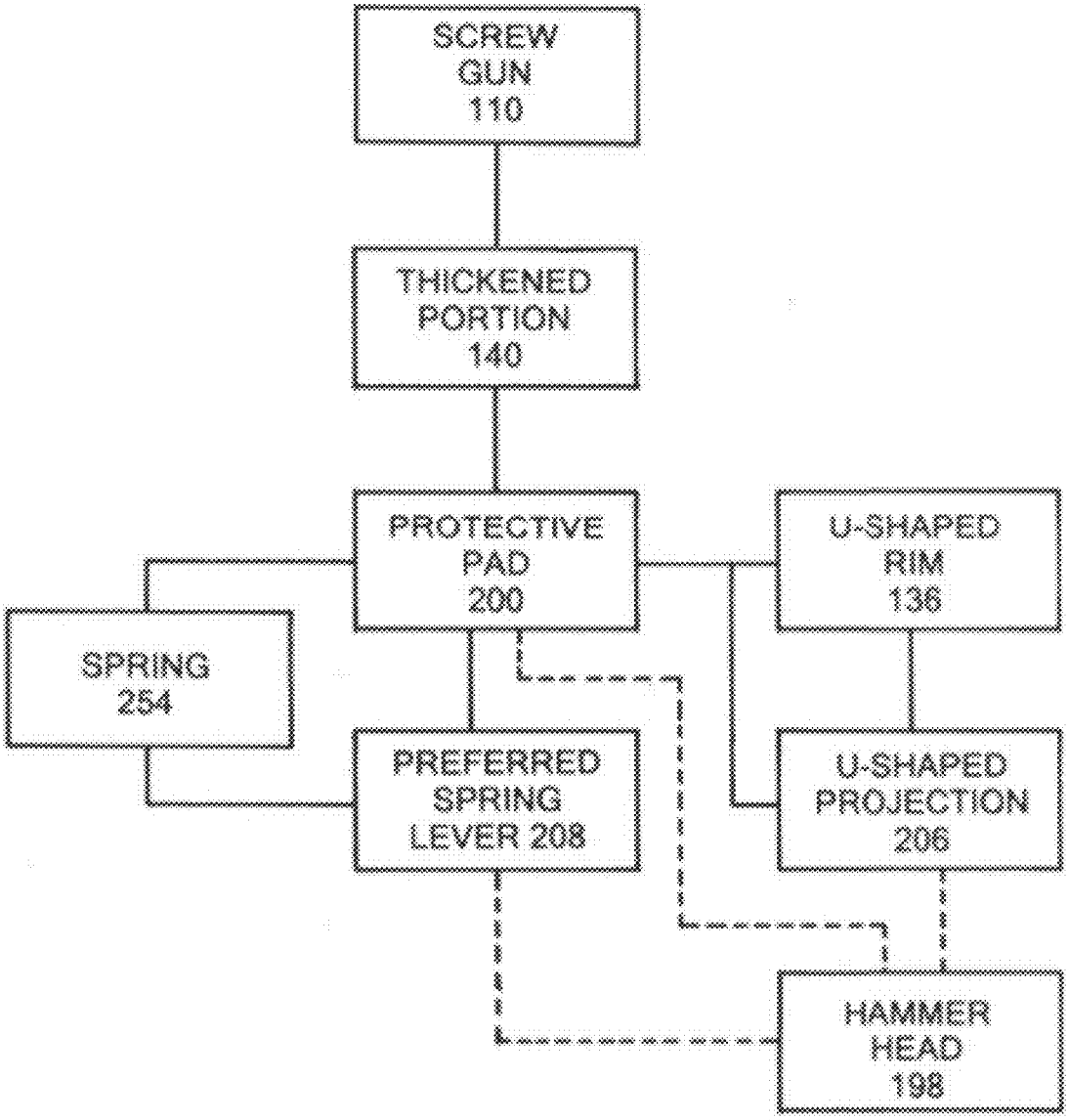
FIG. 10 depicts a block diagram of preferred hammer head 198 of this invention.

Furthermore, adding FIG. 9 to the consideration, an optional addition to hammer head 100 can be seen. Protective pad 200 is added either to locking base 150 or holding head or base 164 (see also FIG. 1). Protective pad 200 can be attached to locking base 150 or holding head or base 164 by any suitable attachment means but glue is the preferred embodiment. Other suitable attachment means can include screws or adhesive tape. Protective pad 200 can be made of rubber, nylon, vinyl, or any other suitable shock absorbing or resilient cushioning material. Protective pad 200 acts as a shock absorber to protect screw gun 110 and the user while the hammering activity occurs.

Figure 11:
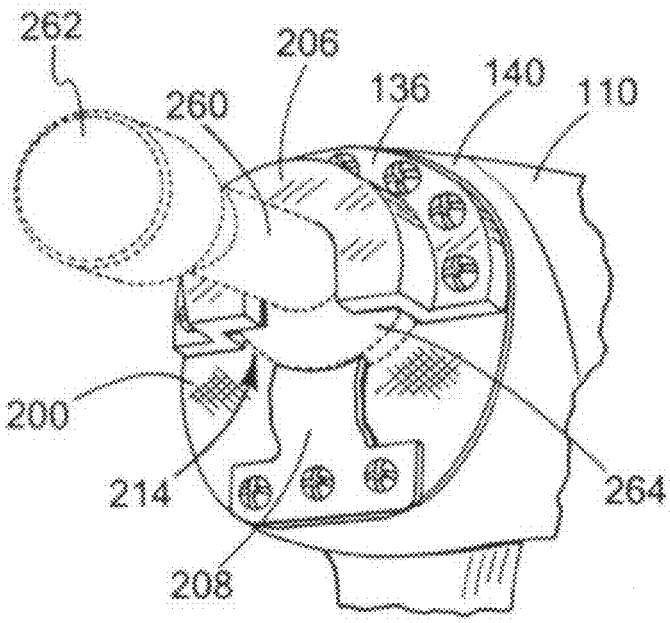
FIG. 11 depicts a rear perspective view of preferred hammer head 198 of this invention.
Figure 12:
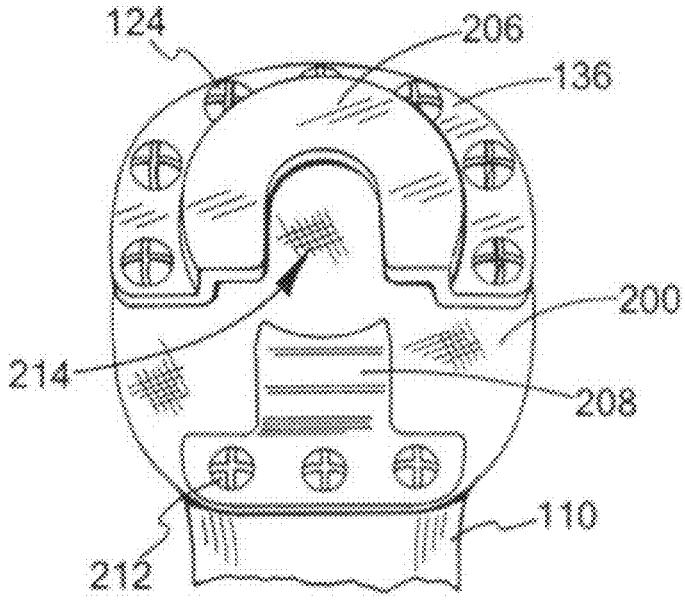
FIG. 12 depicts a rear view of preferred hammer head 198 of this invention.

Now adding FIGS. 10 through 14 to the consideration, a preferred embodiment of hammer head 198 of this invention can be clearly seen. Referring to FIG. 11 and FIG. 12 specifically, hammer head 198 is attached to screw gun 110 through cooperation with U-shaped rim 136 and preferred spring lever 208. In this embodiment, U-shaped rim 136 has a U-shaped projection 206 extending therefrom. U-shaped rim 136 and U-shaped projection 206 accept holding head or base 264 and cooperate with it to securely hold hammer head 198 in place. Moreover, preferred spring lever 208 extends from the base of screw gun 110 and cooperates with holding head or base 264 to further secure hammer head 198 in place. Preferred hammer cradle 214 is supported by U-shaped rim 136, U-shaped projection 206, and preferred spring lever 208. Preferred spring lever 208 presses the holding head or base 264 against the preferred hammer cradle 214 to further secure the position. Preferred hammer cradle 214 is the area in which holding head or base 264 is cradled or secured and is supported by U-shaped rim 136, U-shaped projection 206, and preferred spring lever 208.

Figure 14:
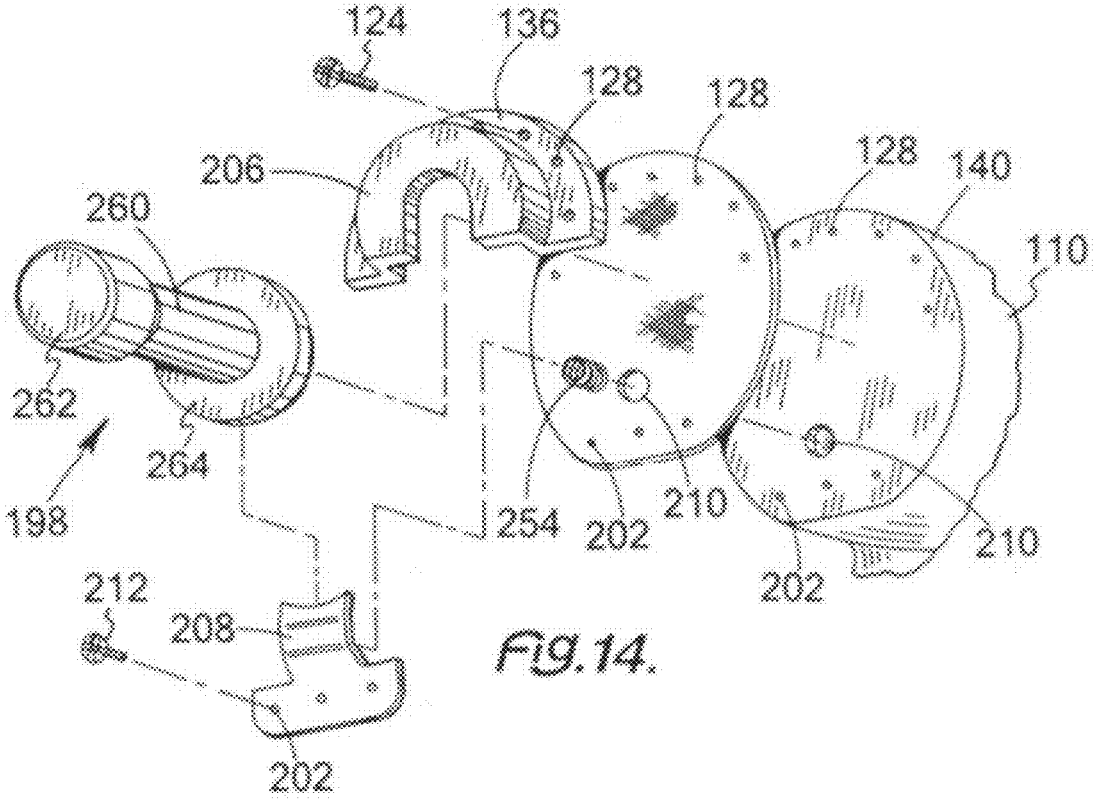
FIG. 14 depicts an exploded perspective view of preferred hammer head 198 of this invention.

Referring specifically to FIG. 13 and FIG. 14, the preferred embodiment of hammer head 198 can be more clearly seen. On the base of screw gun 110, is spring cavity 210, rim apertures 128, and base end apertures 202. Protective pad 200 abuts against screw gun 110. U-shaped rim 136 with U-shaped projection 206 attaches to the upper end of protective pad 200 and screw gun 110. While preferred spring lever 208 attaches to the lower end of protective pad 200 and screw gun 110. Holding head or base 264 is secured in place by U-shaped rim 136 with U-shaped projection 206 and preferred spring lever 208.

Rim apertures 128 are present on the top of base end 112, protective pad 200, and U-shaped rim 136. A series of mounting screws 124, or preferably stainless steel rivets, cooperate with each rim aperture 128 and secure the U-shaped rim 136 and the protective pad 200 to the screw gun 110. The rivets are preferably made of stainless steel however, they can be made of any suitable material that is secure and durable.

Base end apertures 202 are present on the base end of screw gun 110, protective pad 200, and preferred spring lever 208. Clip screw 212, or preferably stainless steel rivets, cooperates with each base end aperture 202 to secure the preferred spring lever 208 and protective pad 200 to screw gun 110.

Any number of base end apertures 202 and corresponding clip screws 212 can be used to secure preferred spring lever 208 to screw gun 110. However, in the preferred embodiment, three base end apertures 202 and clip screws 212 are depicted. Three is the preferred number to prevent preferred spring lever 208 and ultimately hammer head 198 from moving from side to side or back and forth.

Screw gun 110 and protective pad 200 have a spring cavity 210 which cooperates with spring 254. Spring 254 inserts into spring cavity 210. Spring cavity 210 allows functional movement but not walking movement. Thus, spring cavity 210 allows spring 254 to compress and decompress and allows preferred spring lever 208 to be compressed to be flush with the back of screw gun or decompressed to the original position. Thus, spring 254 is securely positioned to allow hammer head 198 to function.

In this embodiment, screws are depicted to secure the protective pad 200, the U-shaped rim 136 with U-shaped projection 206, and the preferred spring lever 208 to screw gun 110. However, these components may be securely attached to screw gun 110 by welding, with rivets, or with any other suitable fastening device or method.

Protective pad 200 can be made of rubber, nylon, vinyl, or any other suitable shock absorbing or resilient cushioning material. Protective pad 200 acts as a shock absorber to protect screw gun 110 and the user while the hammering activity occurs.

Referring specifically to FIG. 13, thickened portion or reinforced backing 140 can be clearly seen. The top portion 142 and the rear portion 144 have a thicker metal layer to increase the durability and longevity of screw gun 110. In the preferred embodiment, the top portion has an added thickness of 1 to 2.54 centimeters (½ to 1 inch) while the rear portion has an added thickness of 1.90 to 3.81 centimeters (¾ to 1.5 inches). The thickened portion 140 of the screw gun 110 is angled upward, extending away from handle 116 as an safety precaution for the user.

To remove or replace hammer head 198, preferred spring lever 208 is depressed. Then, preferred hammer head 198 slides thereover and is removed from preferred hammer cradle 214. Mounting of the preferred hammer head 198 in the preferred hammer cradle 214 requires a reverse procedure. The holding head or base 264 of hammer head 198 extends along to hammer cylinder 260 and then into striking head 262 of preferred hammer head 198. With the support of U-shaped rim 136 with U-shaped projection 206 and preferred spring lever 208, striking head 262 of preferred hammer head 198 may be effectively used, with greatly reduced or eliminated damage to screw gun 110.

Figure 15:
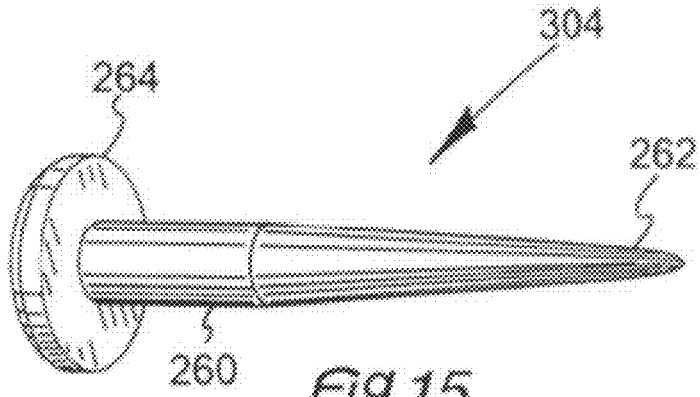
FIG. 15 depicts a front perspective view of center punch 304.
Figure 16:
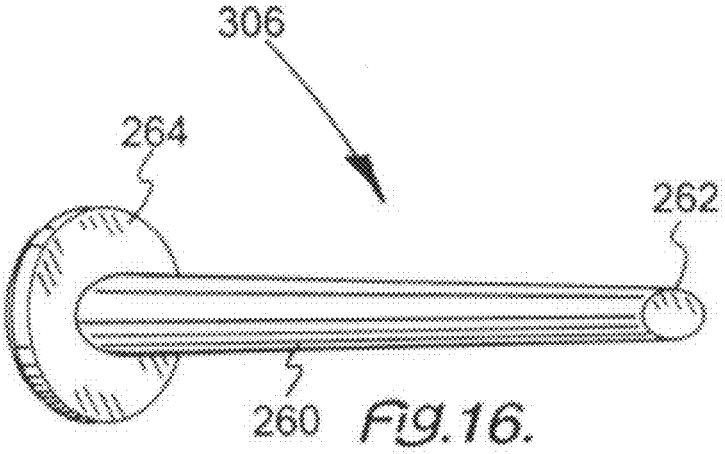
FIG. 16 depicts a front perspective view of steel oval tip head 306.
Figure 17:
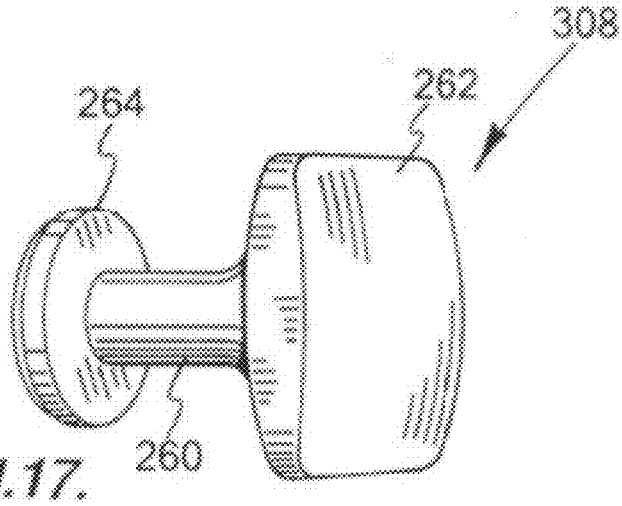
FIG. 17 depicts a front perspective view of steel body work head 308.
Figure 18:
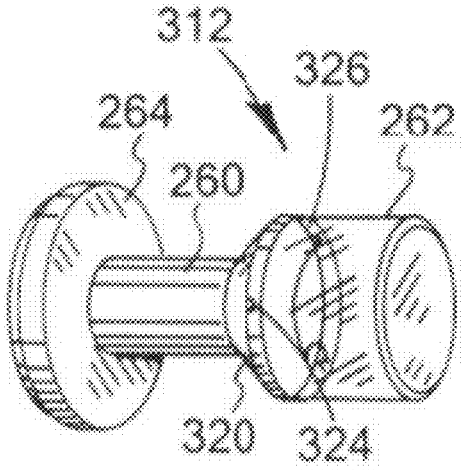
FIG. 18 depicts a front perspective view plastic head 312.
Figure 19:
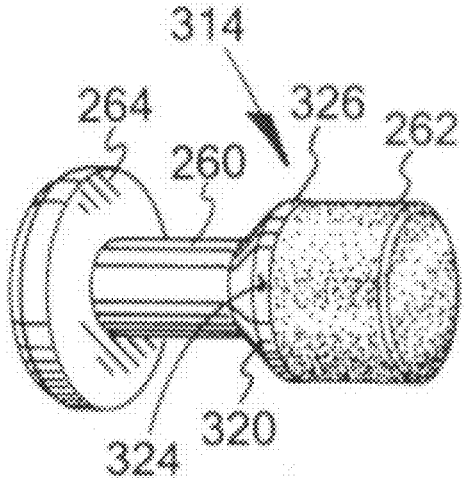
FIG. 19 depicts a front perspective view of rubber head 314.
Figure 20:
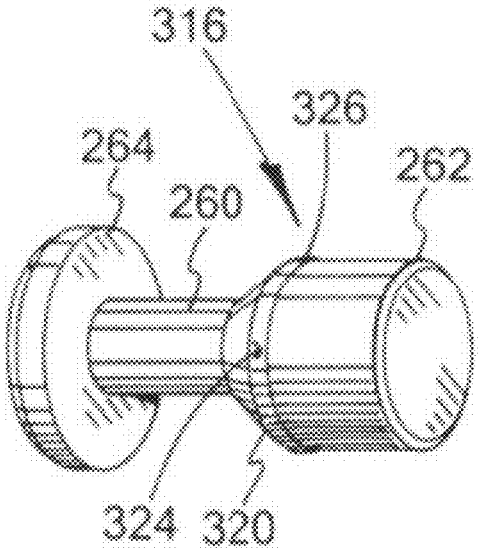
FIG. 20 depicts a front perspective view of brass head 316.
Figure 21:
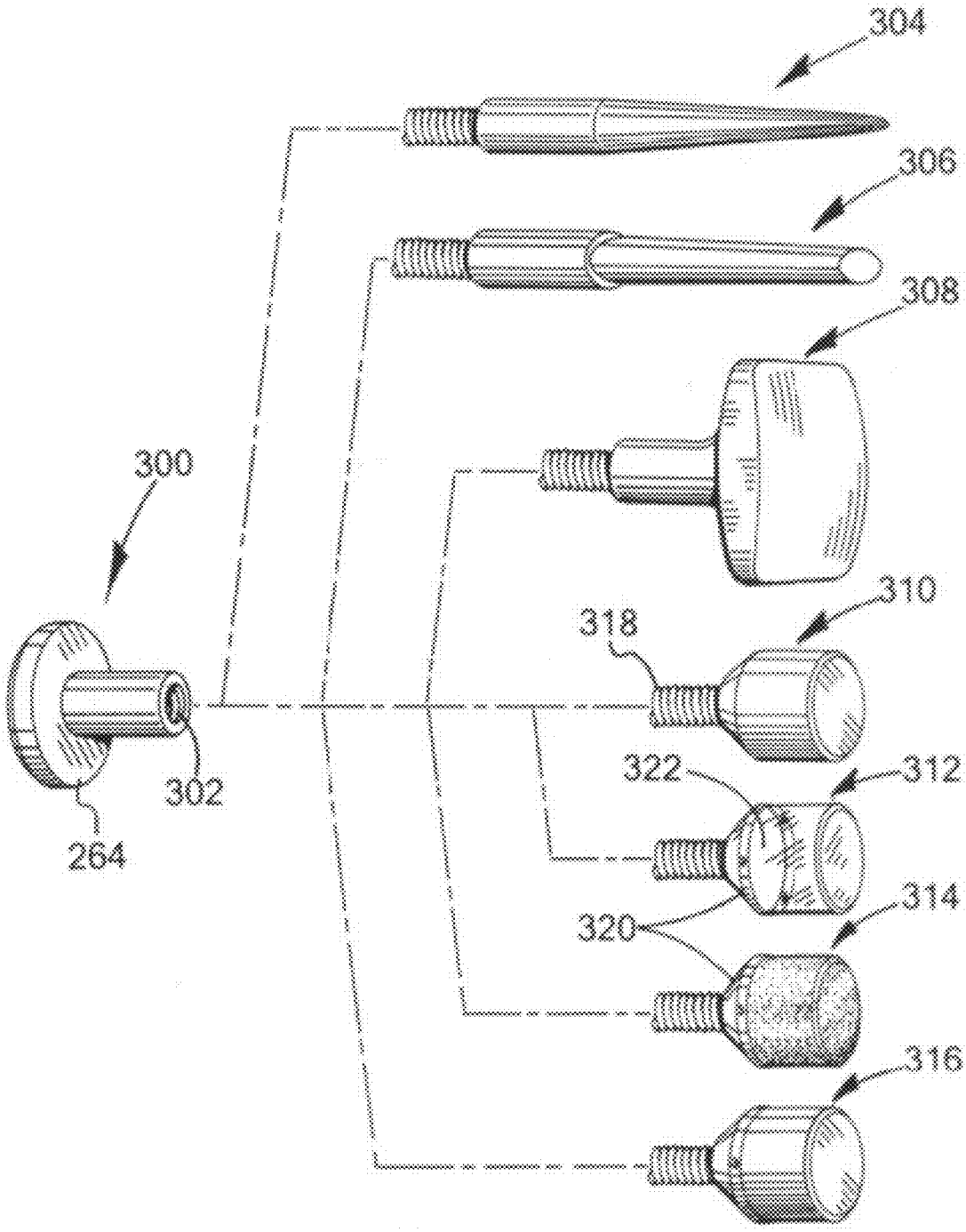
FIG. 21 depicts an exploded perspective view of preferred hammer head 198 with universal insert 300.

Referring to FIGS. 15 through 21, additional embodiments of hammer head 198 can be clearly seen. As seen in FIGS. 15 through 20, a variety of shapes and materials are available for striking head 262. Though these are different embodiments, they will be referred to generically as striking head 262. A variety of steel heads provide great flexibility for workers to perform a variety of tasks with hammer head 198. A standard steel head 310 is depicted in FIG. 21. Moreover, FIG. 15 depicts steel center punch 304, FIG. 16 depicts steel oval tip head 306, FIG. 17 depicts steel body work head 308, FIG. 18 depicts plastic head 312, FIG. 19, depicts rubber head 314, and FIG. 20 depicts brass head 316. Each of these different depictions has the same holding head or base 264, universal insert 300 and female threaded aperture 302 such that each variation is interchangeable on screw gun 110. Thus, screw gun 110 is a versatile and flexible tool.

Steel center punch 304, steel oval tip head 306, and steel body work head 308 can be manufactured by any suitable method or machinery. However, it is preferred that these pieces are manufactured by casting.

Referring specifically to FIGS. 15 through 17, one embodiment of the alternate striking heads 262 can be clearly seen. In this embodiment, the striking head 262, cylinder 260, and holding head or base 264 are a continuous piece. In FIG. 15, center punch 304 has holding head or base 264 which is continuous with hammer cylinder 260 which is continuous with striking head 262.

In FIGS. 18 through 20, the preferred hammer head 198 has two pieces. The holding head or base 264 and the cylinder 260 are a single continuous unit. The cylinder 260 has a tapered metal base 320 (as seen in FIG. 21) which has a base cavity 322 (as seen in FIG. 21). Striking head 262 is inserted into base cavity 322 and secured through any suitable method or device.

Steel base 320 has base cavity 322 which allows a secure and stable attachment to any striking head 262 being utilized. Base cavity 322 is flat and striking head 262 is secured into it by any suitable method or machinery. However, the preferred method is using a punch press and allowing striking head 262 to be pressed into the base cavity 322 and secured with adhesive. Or, a punch or dye may be utilized to stamp or punch the metal of base cavity 322 into striking head 262 in a triangular or three point fashion. Referring specifically to FIG. 18, the three point fashion of divots 324 can be clearly seen. Divots 324 are punched into collar 326. Collar 326 caresses the outer diameter of any of the striking heads 262 but is preferably used on plastic head 312, rubber head 314, or brass head 316. Any number of divots 324 can be used, however three is the preferred amount.

Moreover another embodiment of the alternate striking heads 262 can be clearly seen. Referring specifically to FIG. 21, holding head or base 264 has extending therefrom universal insert 300. Universal insert 300 has a female threaded aperture 302. Striking head 262 is replaced by a variety of alternate heads. Each of these alternate heads have a male threaded stem 318 which cooperates with female threaded aperture 302 to secure it to screw gun 110. At the top of male threaded stem 318 is steel base 320. Steel base 320 supports the head when it is being used as a hammer.

As stated in reference to FIGS. 15 through 20, striking heads 304, 306, 308, and 310 are a continuous unit with metal base 320. In contrast, striking heads 312, 314, and 316 have the threaded stem 318 and the metal base 320 as one unit. The striking head 312, 314, or 316 is a separate unit that is secured to the metal base 320 through base cavity 322 through any suitable attachment means as discussed in reference to FIGS. 18 through 20.

In these embodiments, holding head or base 264 cooperates with U-shaped rim 136 and spring lever 152, 180, or 208. The attachment to screw gun 110 can be in either the preferred fashion as depicted in FIGS. 10 through 21 or in the alternate fashions as depicted in FIGS. 1 through 9.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A portable power screw driver having a reinforced hammer head support and a hammer head comprising:

a) the portable power screw driver having a base end, a handle and a barrel;

b) the base end being situated above the handle;

c) the base end connecting to the barrel;

d) the base end having a hammer cradle;

e) the hammer cradle being adapted to receive and secure the hammer head in place;

f) the hammer head fitting securely into the hammer cradle;

g) the hammer head having a holding head or base to mount into the hammer cradle in a slidable fashion;

h) a spring lever releasably securing the holding head or base in the hammer cradle; and i) a striking head for the hammer head being oppositely disposed from the holding head or base.

2. The portable power screw driver of claim 1 further comprising:

a) the base end of the screw gun having a thickened portion reinforcing the base end with the striking head being used with little or no damage to the screw gun;

b) a U-shaped rim being secured to the base end of the power screw gun; and c) the spring lever at least partially closing the hammer cradle in order to releasably hold the hammer head therein.

3. The portable power screw driver of claim 2 further comprising:

a) a spring cooperating with the spring lever to lock the hammer head to the hammer cradle and to detach the hammer head from the hammer cradle;

b) the spring lever and the U-shaped rim cooperating to provide a hammer cradle to receive the hammer head;
c) a protective pad being inserted between the base end and the U-shaped rim and the spring lever;
d) the spring lever being depressable; and
e) the holding head or base being adapted to depress the spring lever in order to mount the hammer head into the hammer cradle.

4. The portable power screw driver of claim 3 further comprising:
a) the hammer head having a hammer cylinder between the holding head and the striking head;
b) the holding head or base connecting to the hammer cylinder; and
c) the hammer cylinder connecting to the striking head.

5. The portable power screw driver of claim 4 further comprising:
a) the U-shaped rim having a U-shaped projection extending therefrom;
b) the base end and the protective pad having a spring cavity which accepts the spring;
c) the spring cooperating with the spring cavity; and
d) the base end of the screw gun being angled upward and extending away from the handle between 35 and 65 degrees.

6. The portable power screw driver of claim 5 further comprising the striking head being selected from the group consisting of a center punch, a steel oval tip head, a steel body work head, a steel head, a plastic head, a rubber head, and a brass head.

7. The portable power screw driver of claim 5 further comprising:
a) the hammer cylinder being a universal insert, a metal base, and a threaded stem;
b) the holding head or base having the universal insert extending therefrom;
c) the universal insert being hollow with a threaded aperture;
d) the striking head having the metal base extending therefrom;
e) the metal base having the threaded stem extending therefrom which cooperates with the threaded aperture to secure the striking head to the holding head or base; and
f) the striking head being selected from the group consisting of a center punch, a steel oval tip head, a steel body work head, a steel head, a plastic head, a rubber head, and a brass head.

8. In a portable power screw driver comprising a base end, a barrel and a handle wherein the base end connects to the barrel and the handle extends from the base end below the barrel, the improvement including a reinforced hammer head support on the base end and further comprising:
a) the base end being situated above the handle;
b) the base end connecting to the barrel;
c) the base end having a hammer cradle mounted thereon;
d) the hammer cradle being adapted to receive and secure a hammer head in place;
e) a hammer head fitting securely into the hammer cradle;
f) the hammer head having a holding head or base to mount into the hammer cradle in a slidable fashion;
g) a spring lever releasably securing the hammer head in the cradle; and
h) a striking head for the hammer head being oppositely disposed from the holding head or base.

9. The portable power screw driver of claim 8 further comprising:
a) the base end of the screw gun having a thickened portion reinforcing the base end with the striking head being used with little or no damage to the screw gun;
b) the cradle defining a U-shaped rim secured to the base end of the power screw gun; and
c) the spring lever at least partially closing the hammer cradle in order to releasably hold the hammer head therein.

10. The portable power screw driver of claim 9 further comprising:
a) a spring cooperating with the spring lever to lock the hammer head to the hammer cradle and to detach the hammer head from the hammer cradle;
b) the spring lever and the U-shaped rim cooperating to provide a hammer cradle to receive the hammer head;
c) a protective pad being inserted between the base end and the U-shaped rim and the spring lever;
d) the spring lever being depressable;
e) the holding head or base being adapted to depress the spring lever in order to mount the hammer head into the hammer cradle; and
f) the base end of the screw gun being angled upward and extending away from the handle between 35 and 65 degrees.

11. The portable power screw driver of claim 10 further comprising:
a) the hammer head having a hammer cylinder between the holding head or base and the striking head;
b) the holding head or base connecting to the hammer cylinder;
c) the hammer cylinder connecting to the striking head;
d) the U-shaped rim having a U-shaped projection extending therefrom;
e) the base end and the protective pad having a spring cavity which accepts the spring; and
f) the spring cooperating with the spring cavity.

12. The portable power screw driver of claim 11 further comprising: the striking head being selected from the group consisting of a center punch, a steel oval tip head, a steel body work head, a steel head, a plastic head, a rubber head, and a brass head.

13. The portable screw driver of claim 11 further comprising:
a) the hammer cylinder being a universal insert, a metal base, and a threaded stem;
b) the holding head or base having the universal insert extending therefrom;
c) the universal insert being hollow with a threaded aperture;
d) the striking head having the threaded stem which cooperates with the threaded aperture to secure the striking head to the holding head or base; and
e) the striking head being selected from the group consisting of a center punch, a steel oval tip head, a steel body work head, a steel head, a plastic head, a rubber head, and a brass head.

14. The portable power screw driver of claim 9 further comprising:
a) the spring lever being a free spring arm;
b) the free spring arm touching the holding head;
c) the hammer head having a holding head or base, a hammer cylinder and a striking head;
d) the holding head car base connecting to the hammer cylinder;
e) the hammer cylinder connecting to the striking head;
f) the spring lever and the U-shaped rim cooperating to provide a hammer cradle to receive the hammer head;

g) a protective pad being inserted between the base end and the U shaped rim and the spring lever;

h) the holding head or base being adapted to depress the spring lever in order to mount the hammer head into the hammer cradle; and i) the base end of the screw gun being angled upward and extending away from the handle between 35 and 65 degrees.

15. The portable power screw driver of claim 10 further comprising the spring lever being supported by a coil spring.

16. A portable power screw driver having a reinforced hammer head support and a hammer head comprising:

a) the portable power screw driver having a base end, a handle and a barrel;

b) the base end being situated above the handle;

c) the base end connecting to the barrel;

d) the base end having a cradle mounted thereon;

e) the cradle being adapted to receive and secure the hammer head in place;

f) the hammer head fitting securely into the cradle;

g) the hammer head having a holding head to mount into the cradle in a slidable fashion;

h) a spring lever releasably securing the holding head or base in the cradle;

i) a striking head for the hammer head being oppositely disposed from the holding head; and j) a U shaped rim being secured to the base end of the power screw gun.

17. The portable power screw driver of claim 16 further comprising:

a) the base end of the screw gun having a thickened portion reinforcing the base end with the striking head being used with little or no damage to the screw gun;

b) the spring lever at least partially closing the hammer cradle in order to releasably hold the hammer head therein;

c) the hammer head having a hammer cylinder between the holding head and the striking head;

d) the holding head connecting to the hammer cylinder;

e) the hammer cylinder connecting to the striking head;

f) a protective pad being inserted between the base end and the U-shaped rim and the spring lever;

g) a spring cooperating with the spring lever to lock the hammer head to the hammer cradle and to detach the hammer head from the hammer cradle;

h) the spring lever being depressable;

i) the holding head being adapted to depress the spring lever in order to mount the hammer head into the hammer cradle;

j) the U-shaped rim having a U shaped projection extending therefrom; and k) the base end of the screw gun being angled upward and extending away from the handle between 35 and 65 degrees.

18. The portable power screw driver of claim 17 further comprising the striking head being selected from the group consisting of a center punch, a steel oval tip head, a steel body work head, a steel head, a plastic head, a rubber head, and a brass head.

19. The portable power screw driver of claim 17 further comprising:

a) the hammer cylinder comprising a universal insert, a threaded stem, and a metal base;

b) the holding head or base having the universal insert extending therefrom;

c) the universal insert being hollow with a threaded aperture;

d) the striking head having the threaded stem which cooperates with the threaded aperture to secure the striking head to the holding head or base; and e) the striking head being selected from the group consisting of a center punch, a steel oval tip head, a steel body work head, a steel head, a plastic head, a rubber head, and a brass head.

20. The portable power screw driver of claim 16 further comprising:

a) the spring lever being a free spring arm;

b) the free spring arm touching an edge of the holding head;

c) the free spring arm at least partially closing the hammer cradle in order to releasably hold the hammer head therein;

d) the base end of the screw gun having a thickened portion reinforcing the base end with the striking head being used with little or no damage to the screw gun;

e) the U-shaped rim being secured to the base end of the power screw gun;

f) the spring lever at least partially closing the hammer cradle in order to releasably hold the hammer head therein;

g) the hammer head having a holding head or base, a hammer cylinder and a striking head;

h) the holding head or base connecting to the hammer cylinder;

i) the hammer cylinder connecting to the striking head;

j) a protective pad being inserted between the base end and the U-shaped rim and the spring lever;

k) the spring lever being depressable; and l) the holding head or base being adapted to depress the spring lever in order to mount the hammer head into the hammer cradle.

* * * * *